US005259907A

United States Patent [19]

Soules et al.

[11] Patent Number: 5,259,907

[45] Date of Patent: Nov. 9, 1993

[54] METHOD OF MAKING CODED PLAYING CARDS HAVING MACHINE-READABLE CODING

[75] Inventors: Jack A. Soules, Shaker Heights; Bryan D. Carpenter, Cleveland, both of Ohio

[73] Assignee: Technical Systems Corp., Cleveland, Ohio

[21] Appl. No.: 983,973

[22] Filed: Dec. 1, 1992

Related U.S. Application Data

[60] Division of Ser. No. 796,765, Nov. 25, 1991, Pat. No. 5,169,155, which is a continuation-in-part of Ser. No. 501,148, Mar. 29, 1990, Pat. No. 5,067,713.

[51] Int. Cl.[5] ..... B32B 31/00; B41M 31/00

[52] U.S. Cl. ..... 156/277; 156/310; 273/293; 283/74; 283/79; 283/88; 283/89; 283/94; 283/901

[58] Field of Search ..... 156/277, 310, 67; 283/74, 79, 87, 88, 94, 901; 273/292, 293, 295, 296

[56] References Cited

U.S. PATENT DOCUMENTS

| | | | |
|---|---|---|---|
| 3,640,009 | 2/1972 | Komiyama et al. | 283/88 |
| 4,534,562 | 8/1985 | Cuff et al. | 273/149 P |
| 4,662,637 | 5/1987 | Pfeiffer | 273/149 P |
| 4,746,789 | 5/1988 | Gieles et al. | 235/462 X |
| 4,889,367 | 12/1989 | Miller | 283/88 |

FOREIGN PATENT DOCUMENTS 3807127 9/1989 Fed. Rep. of Germany ..... 273/292

*Primary Examiner*—David A. Simmons
*Assistant Examiner*—M. Curtis Mayes
*Attorney, Agent, or Firm*—Alfred D. Lobo

[57] ABSTRACT

An apparently conventional playing card is invisibly coded so that it can only be read face down, by an electrooptic reading means. The card may be of non-laminated conventional card stock which has a substantially white surface conventionally printed with the identification of the suit and value of the card with inks chosen because they are visible but substantially transparent to wavelengths outside the visible range. The face of the card is coded with indicia inklessly marked across its surface with a compound which absorbs wavelengths (outside the visible range) which wavelengths are used by the reading means to read the indicia. The indicia, invisible to the human eye, correspond to a code which uniquely identifies the card. The card may be laminated from top and base sheets and the code concealed behind the front printed face of the top sheet. The upper surface of the top sheet is imprinted with the face value of the card with the inks described. The base sheet serves as a support layer, either for the indicia per se, or for an intermediate layer on which the indicia may be printed. The code is read because there is sufficient contrast between the transmitted and absorbed light in the wavelength used by the reading means. A coating or auxiliary layer may be provided to enhance the contrast.

17 Claims, 4 Drawing Sheets

METHOD OF MAKING CODED PLAYING CARDS HAVING MACHINE-READABLE CODING

This is a division of parent application Ser. No. 07/796,765 filed on Nov. 25, 1994, to be issued as U.S. Pat. No. 5,169,155 which is a continuation-in-part application of Ser. No. 07/501,148 filed Mar. 29, 1990, issued as U.S. Pat. No. 5,067,713.

BACKGROUND OF THE INVENTION

This invention relates to a playing card which is coded with an arbitrarily chosen machine-readable indicia not visible to the human eye. In one embodiment, a card's face is coded in a unique pattern visible only in the infrared or ultraviolet regions, without being visibly defaced. The coded card is an otherwise conventional playing card formed from a single non-laminated sheet of flexible material ("card stock"), such as paper, preferably coated with a cured latex of an acrylate-containing polymer.

In another embodiment, the card is a laminated playing card comprising an upper lamina of flexible card stock, a lower lamina (base) of the same or another flexible stock, and an intermediate layer sandwiched therebetween. The laminated card is coded in the region between the upper lamina and the lower lamina, which region is referred to as the intermediate layer, in a manner such that an electronic device can identify the value of the card and access whatever other information the code may have been devised to reveal. In a specific embodiment, the code indicates to an electronic "reader" (of the hidden code) what the value of the card is, and where each card in a deck or set of cards is to be dealt without the dealer knowing the identification of the card.

As one skilled in the art will readily appreciate, coding a deck of playing cards, each with a visible (to the human eye) code, for example a standard Hollerith pattern or "bar code", by which each card is uniquely identified, is a routine task. To code a card without the code being visible to the human eye, so that a deck of cards may be read by a machine viewing only the faces of the cards which are passed, face downwards, over the reading means of a machine, without defacing the cards and essentially without regard for the orientation of the card as it is passed over the reading means, is not a routine task.

Coded playing cards coded as disclosed in U.S. Pat. No. 4,534,562 to Cuff et al, were conventionally marked with a binary code along its opposite edges so that the code could be seen by the human eye (read by light in the range of visible wavelengths). Since there was no concern about hiding the fact that the cards were coded the necessity of overprinting the faces of the cards did not arise, and the cards were marked on the side edges.

The face of a package of corn chips provided the substrate which was marked with machine readable information overprinted on human-readable symbology, each with a different type of ink in U.S. Pat. No. 4,889,367 to Miller. The human-readable ink absorbs energy in the visible wavelength, but insufficient energy in another wavelength range to prevent a bar-code reading machine ("reader") from reading the bar code. Such a two-ink printing of a bar code on a substrate was well-suited for a package to be read when passed across a grocery store counter where the laser reading the bar code rotates until it can read the code. However, since the orientation of the bar code is fixed on each of the foregoing substrates in the '367 and '562 patents, the code can only be read in one direction by a reader having a fixed light source.

Moreover, it is difficult to find infrared or ultraviolet-absorptive inks which do not absorb in the visible region, that is, have essentially no color. Though inks having very specific energy absorption and reflection characteristics are commercially available, if only on special order, no suggestion or illustrative example of an infrared or ultraviolet absorbing ink which does not substantially absorb in the visible region, is provided in the '562 or '367 patents. Thus the "invisible" bar code of the '367 patent, in practice, is limited to use on colored substrates, such as a mustard color on a bag of chips, or the brown or blue of other snack foods.

Since playing cards traditionally have their face values printed against a very white background, the prior unavailability of colorless "inks" did not provide a practical solution to the problem. Still further, there is no suggestion in the prior art as to what kind of infrared "ink" would be unaffected by the repetitive shuffling, sorting, and sliding of playing cards, face down on a table, all of which actions tend to scuff the cards and the ink, making it difficult to read the code.

Our playing card uses an essentially invisible bar code which can be read only by an electro-optical reading means which uses light in the infrared or ultraviolet region, as described in greater detail hereinbelow, whether the card is laminated or not.

In the non-laminated card of conventional card stock, the code is inklessly textured or etched into the face of the card. By the terms "textured or etched" (which terms are used interchangeably herein) we mean that the surface is either scuffed (or etched) so that the fibers of the card stock are disrupted (typically raised) relative to the fibers which have not been scuffed; or, the surface is impregnated without using a pigment (such as are used in inks), but using a dye or microscopic powder which has essentially no pigmenting value. In either case the surface of the card is said to be "textured". By "inklessly" we mean without using a pigmented liquid or paste used especially for writing or printing. Inkless writings include the symbols on the screen of a compuer's monitor or on a television tube, script or other symbols cut into stone or other durable surface, and messages in smoke written across the sky, inter alia.

For the first time, we have now been able to provide a playing card of card stock which can be marked all over the card's face, if so desired, then overprinted with the face value of the card without visibly changing the "normal" appearance of the card, or vice versa changing the sequence of operations. The unexpected result of being able to code a playing card essentially invisibly by texturing or etching, is that the face of the card may be textured or etched with the code repetitively, or the intermediate layer may be textured or etched with the code repetitively, thus enabling the card to be read in any generally lateral orientation whatsoever, as long as it passes over, preferably in contact with, the machine which reads it. Of course, the card may also be textured or etched with the code in such a manner that the reader will read the code in any generally fixed direction (say along the horizontal x-axis), whether the card is introduced to the reader from either end along the axis.

More preferably, the card is laminated, as stated above, and only the intermediate layer carries the code imprinted on it. As in the case of the non-laminated card, the intermediate layer may be printed with the code repetitively, thus enabling the card to be read, as before, in any generally lateral orientation whatsoever, as long as the card passes over the machine which reads it. And, as before, the card may also be read in any generally fixed direction, if the option or flexibility of presenting the card in an arbitrary lateral orientation is not desired.

More generally the laminated embodiment of this invention relates to providing a machine-readable code in a standardized document such as a credit card, executed original contract, warranty deeds, bearer bonds, passports, credit cards, identification cards and the like. For example, the ubiquitous "plastic card" made according to this invention, may have a code hidden within it which is relatively non-susceptible to wear because it is protected by the upper and lower laminae which have specified optical properties, described in greater detail herebelow. The upper and lower laminae are self-supporting sheets of material which serves as the top and base layers, respectively, of the laminated card.

The term "lamina" is used to emphasize the fact that the sheet is self-supporting and of appreciable thickness, at least about 0.5 mil (0.0005 inch) thick. The terms "top layer" or "upper layer" and "base layer" or "lower layer" are used synonymously with "upper lamina" and "lower lamina" herein only because the former terms are less awkward and more familiar than the latter. The term "intermediate layer" refers either to a selectively reflective non-self-supporting layer typically less than about 0.5 mil thick, or a combination of the non-self-supporting layer with a supporting layer the optical properties of which are immaterial. A non-self-supporting layer, typically consisting essentially of solid particles from 0.1μm–5μm (micrometer) may be sputter-coated or vacuum deposited; particles up to 44μm in average size may be conventionally deposited; while films less than 0.5 mils (0.0005") thick, say from 10μm to formed by known means. A non-self-supporting intermediate layer less than 0.0005" thick may consist of only the particles which define the code, or such particles supported on a thin film of material, preferably a polymeric film.

The face of the upper layer of the standardized document carries the human-readable insignia and comprises a selectively reflective lamina, substantially fully light-reflective in the visible, and substantially transparent (light-permeable) in the infrared or ultraviolet regions. The electrical conductivity of the upper layer is irrelevant, as is that of the base layer, provided such conductivity, if present, does not interfere with operation of the device used to read the coded intermediate layer of the laminated card.

Though the principles upon which the interaction of the components of the laminated standardized document, and more specifically, of the laminated playing card, are well known in optical physics, the choice of the components with a view to their desired interaction is unique.

The device to deal a deck of cards so that a preselected "hand" stored in the memory of the device, is dealt to each player, and to do so in an error-free, repetitive manner, has been disclosed in the parent case. Since the reader (device) is for use by groups of card-playing enthusiasts, it was essential, under the circumstances, that the device be affordable to such groups. The affordability of the device is also an advantage in those situations where standardized documents other than a playing card, are to be read.

The matter of economics for card-playing groups is of particular importance because the game of Contract Bridge is played by a large segment of the population of the world, and the typical person in such a group is not in a position to pay much for any device with which he may practice playing preselected hands, or one he uses to teach himself how to play the game more astutely, or to participate in the game of Duplicate Bridge.

Duplicate Bridge is played in essentially the same manner all over the world as a test of skill in a game in which the same deal is played more than once at different tables. Thus it becomes important that many decks of cards be dealt in preselected sets of 13 cards each to each set of competitors.

It will now be evident that the apparatus and coding system of this invention can also be used to deal hands in the game of poker, or any other card game in which specific cards are to be dealt to a specified location according to directions provided by the memory of the device.

The device is particularly useful as a teaching device because an electronic "chip" can be provided with "teaching hands", and the level of the game being taught can be tailored to the expertise of the learner by simply replacing one chip with another.

Further details for playing the game of Duplicate Bridge, or any other card game where a deck of cards is to be dealt in a prescribed manner, are not of particular importance here. The thrust of this invention is that, in its most preferred embodiment, it provides a playing card which can be read by a device for manually dealing a deck of cards, or any portion thereof, in a preselected manner, by simply sliding each card, face down, across a surface in which electrooptical reading means to identify the card, and means to match the identification of the card with an instruction in the device's memory, result in a signal being given to the dealer as to where (which location) that card is to be dealt.

SUMMARY OF THE INVENTION

It has been discovered that each playing card in a deck of playing cards may be identified with machine-readable indicia essentially invisible to the human eye, to sort the deck without the person sorting the cards seeing their face values. If a person was to sort a deck of cards manually, he would of course, read the printed identification of each card which designates its "suit" (whether, spades, hearts, diamonds or clubs) and its designation in the suit (Ace, King, Queen, etc.). To sort the deck with a "reader", each card, face down, is manually slid across a surface of the reader, to read the contrasted code against the background, the orientation of the card preferably being of no consequence.

In a non-laminate ("card stock") card, the concealed machine-readable coding indicia may be (a) imprinted inklessly by texturing or etching along each margin of the card, or, over the entire surface of the card's face; or (b) imprinted with visible-light-permeable dyes, along each margin of the card, or, the entire surface of the card's face.

In a laminated card, the concealed, machine-readable coding indicia is imprinted on an intermediate layer, either as a single set of coding indicia (say, a bar code) readable from either of two generally axially opposed directions; or, as multiple coding indicia (plural sets of bar codes, say) readable from any arbitrary direction so long as the card is kept face down. The coding indicia may also be imprinted along each margin of the intermediate layer, or, the entire surface of the intermediate layer.

If the code is imprinted unidirectionally, say in the direction of the longitudinal axis of the card, then the card will be read as long as a portion of the card carrying the imprinted code passes transversely (that is, not parallel to the direction in which lines of the indicia are marked on the card) over an electro-optical reading means which identifies the card. The code read is then compared to a predetermined list of locations to determine to which player position (North, South, East, West) the card is to be dealt. A signal is then generated to indicate to which position the identified card is to be dealt, and the dealer deals the card to the indicated position. The signal may be visual, for example a light, or it may be an audio signal or a speech processor within the device stating "North", "South", etc. to identify the location to which the card is to be delivered.

It is a specific object of this invention to provide a non-laminated playing card with a surface identified with inkless indicia which are essentially invisible to the human naked eye but which can be read by an electro-optical reading means sensitive to wavelengths in the infrared or ultraviolet light regions, each of which is outside the wavelength in the visible range, that is, light with wavelength shorter than about 4000 Angstroms or longer than about 7000 Angstroms (or 0.4μm–0.7μm, or 400 nm—700 nm "nanometers"). The card may be read laterally, either substantially unidirectionally, from either end but face down; or, without regard for the card's face-downwards lateral orientation.

It is another specific object of this invention to provide a non-laminated playing card which is coded across its entire face, or along each of the four margins thereof, with inkless indicia which are essentially invisible to the naked eye but which can be read by an electro-optical reading means sensitive to light in the wavelength range above about 7000 Å Angstroms (700 nm) but below about $2.2\times10^5$ Å, preferably in the infra-red range from about 800–$10^4$ nm, more preferably 800–2000 nm (near infrared). Coding with indicia imprinted or otherwise marked across the entire surface or along each margin, any portion of the surface or margin completely identifying each card, allows any portion of the card to be passed over the electro-optical reading means and be read without regard for its face-downwards orientation.

It is a specific object of this invention to provide a laminated playing card having (1) an upper lamina or top layer which is selectively light-permeable to light in the infrared, ultraviolet and visible regions, and the face of the top layer is imprinted with the value of the card; (2) a lower lamina or base layer which serves as a supporting layer for (3) an intermediate, selectively light-reflective coded layer which is sandwiched between the upper and lower laminae, so that the code on the intermediate coded layer may be read by a device using light in a predetermined wavelength to which the upper lamina is permeable, and which predetermined wavelength is selectively reflected/absorbed by the intermediate layer and coding indicia thereon, so as to provide sufficient contrast to be read by a "reader".

The upper lamina is made from material which reflects substantially all light in the visible spectrum, that is, the top layer is nearly opaque. The face of the upper lamina is printed with inks in colors which identify each card in the deck, and these inks on card stock also reflect substantially all light in the visible spectrum. By "substantially all light" we refer to at least about 80% of the light in the visible spectrum being reflected, the remaining 20% or less being transmitted.

The intermediate layer preferably reflects substantially all infrared or ultraviolet light; this layer is provided with coded indicia readable by a reader which uses either infrared or ultraviolet light to read the code. The coded intermediate layer is substantially coextensive with the document. When the document is held up and viewed against a bright light in the visible spectrum, only the patterns, specifically the face values of the playing cards, imprinted with colored inks, and the decorative pattern on the back of the card, can be seen (depending which layer is directly before the viewer's eyes), and the code on the intermediate layer is not visible to the human eye. The intermediate layer being sandwiched between the upper lamina and lower lamina is held therebetween. The optical properties of the base layer, whether it is permeable to light of any wavelength or not, is not material to its function herein.

It is a specific object of this invention to provide a laminated label or other standardized document the upper (top) layer of which is made of material which is substantially reflective in the visible spectrum and is marked with visible indicia in colored inks, but the material and colored inks are both permeable to infrared or ultraviolet light; the intermediate layer is light-reflective and substantially coextensive with the document, the intermediate layer having a code imprinted thereupon which absorbs light in a predetermined wavelength range, the intermediate layer being sandwiched between the upper layer and a base layer which supports the intermediate layer, the optical properties of which base layer being immaterial to the code-reading function of the card.

BRIEF DESCRIPTION OF THE DRAWINGS

The foregoing and additional objects and advantages of the invention will best be understood by reference to the following detailed description, accompanied with schematic illustrations of preferred embodiments of the invention, in which illustrations like reference numerals refer to like elements, and in which.

DETAILED DESCRIPTION OF PREFERRED EMBODIMENTS

Figure 3:
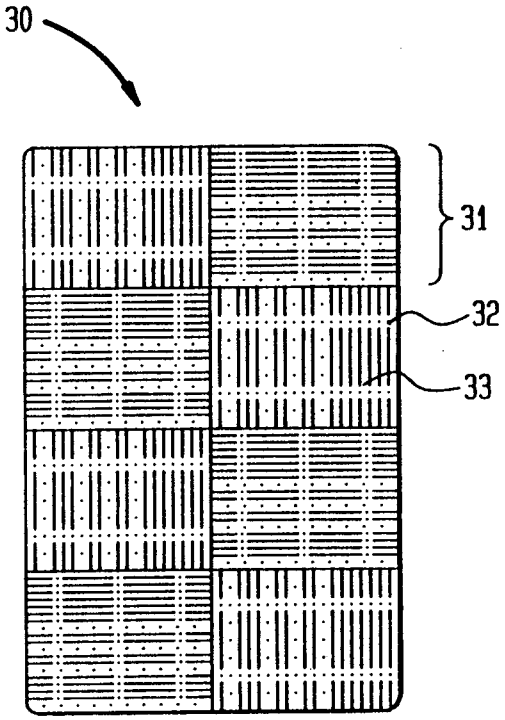
FIG. 3 is a representation of the playing card in which the face value of the card is not shown, but only showing still another bar coding as phantom shaded portions in discrete blocks across the entire face, the code being alternated in longitudinal and vertical directions, so that the card will be read as long as a portion of the card passes over the electro-optical reading means.

The preferred card reader comprises a housing which is a generally rectangular parallelepiped having a planar surface at least a portion of which is permeable (that is, transparent) to the wavelength to be used to read a playing card passed laterally over the surface, preferably in surface-to-surface contact therewith. A typical card reader has a housing approximately 18 cm long and 12 cm wide with a depth of about 4 cm. It will be readily apparent to one skilled in the art that the overall size of the housing may be shrunk substantially so that the area of the deck is comparable to that of a standard playing card, such shrinkage entailing "surface-mount" technology and an appropriately compact power source. The degree to which such shrinkage is justified will be dictated by the ultimate cost of the device. Within the housing is mounted an electro-optical reading means having an "eye" aimed directly upwards through that portion of the platform which is permeable. The platform is preferably flat, but may be shaped to conform to cards of arbitrary curvature, or which are bent or curved in being passed in contact with the platform's surface.

In the best embodiment the device uses either an infrared or ultraviolet source and matching detector and responds to the differences in reflectivity and absorptivity of the prepared, coded surface, or intermediate layer, of each card. In the ultraviolet case, the coded surface, whether of the upper layer or the intermediate layer, may vary in either reflectivity or absorptivity, or in fluorescence. In the latter case, the detector would be chosen to respond to visible fluorescence excited by the ultraviolet. Thus it is seen that the detector may be chosen to respond to actinic radiation whether such radiation is below 4000Å or above 7000Å provided that either the actinic radiation or the fluorescence generated is essentially invisible to the human eye.

More specifically, Table I lists the various combinations of sources, appropriate detectors and the optical response which is monitored.

TABLE I

| Source | Detector | Optical response |
|---|---|---|
| IR | IR | Differential reflectivity or long wavelength fluorescence |
| Visible | IR | fluorescence |
| UV | Visible | fluorescence |
| UV | UV | reflectivity |

The reading means for the reader is mounted on a control board on the underside of which is also mounted a microprocessor and other solid-state components. Battery means provide a convenient power source in the form of several sub-C cells each having a normal voltage of 1.25 volts. Keys are operatively connected to the solid-state devices on the control board to provide the functions described hereinafter in the flow charts.

The solid-state elements which interact to provide the above-described functions include a microprocessor; an erasable programmable memory; a peripheral interface adapter which interfaces the reading means, an indicating means which may be a speech processor or indicating lights positioned at each location to which the cards are to be dealt, and the keys. A first multiple Schmidt trigger and a serial shift register converts raw light pulses to a digital word. A read-write random access memory is used to store preset operating conditions, for example, a specifically chosen deal. A low current, reed-type relay controls power-on and power-off. An address decode determines the architecture of the memory. A second multiple Schmidt trigger together with a resistance-capacitor network determines the operating clock frequency of the MPU (microprocessor unit).

Details relating to the foregoing will be found in the parent application, along with illustrative drawings, more fully to understand the scope of the invention claimed herein.

THE CARD STOCK (NON-LAMINATED) PLAYING CARD

Figure 1:
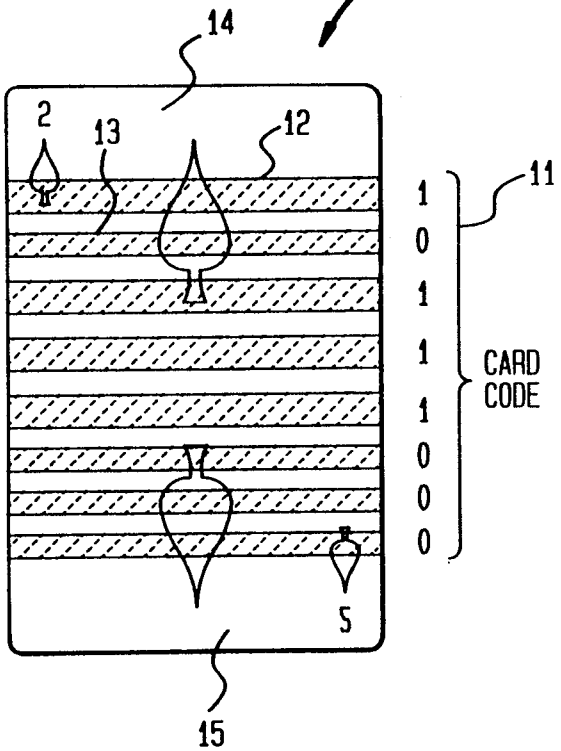
FIG. 1 is a representation of a playing card, specifically the two of spades, showing a typical bar coding as phantom shaded portions since they are not visible to the naked eye. The bars traverse the width of the card in a direction at right angles to the longitudinal axis of the card and are textured on the face markings of the card, which of course are not affected by the texturing since the bar codes are invisible to the human eye. The bar codes may also be textured in the longitudinal direction instead of the vertical direction as shown. In either case, the bar code will be read in either direction along the longitudinal axis as long as the card is passed in a direction transverse (that is, not parallel) to the direction in which the bars are textured, so long as a portion of each bar of the code is read.

As shown in FIG. 1, the face of the 2 ♠ (2 of spades), referred to generally by reference numeral 10, is marked with a bar code identified as the "card code" 11 consisting of spaced apart wide bars 12 and narrow bars 13, which bars extend from near one (upper) longitudinal margin 14 to the other (lower) 15. The bars run in a horizontal direction at right angles to the vertical axis of the card. A wide bar 12, in this illustration, represents the binary digit 1, and a narrow bar 13 represents the binary digit 0. A wide bar is typically from 50% to about 300%, preferably 100% wider than a narrow bar. The width of the spacing between bars is not narrowly critical provided it is at least as wide as a narrow bar. Each wide and narrow bar represents a zone of contrasting reflectivity relative to the background, that is, the spacing between bars, and the space around them.

By way of example for this specific illustration, four bits are used to identify the face value of the card, and two bits to identify the suit. A series of 8 bars makes one byte and each card is uniquely identified by a combination of six bits within the series, the other two bits being used to determine the orientation of the card being read, and to detect errors. To read the code in FIG. 1, some portion of each opposed longitudinal edge of the card must pass over the reading means. A card code typically includes bars which allow the code to be read from either direction along the longitudinal axis.

The following Table 2 represents each value of a card in a deck, in binary form.

TABLE 2

| | Card Value | | | | | | | | | | | | |
|---|---|---|---|---|---|---|---|---|---|---|---|---|---|
| Bit | A | 2 | 3 | 4 | 5 | 6 | 7 | 8 | 9 | 10 | J | Q | K |
| 1 | 0 | 1 | 1 | 1 | 1 | 1 | 0 | 0 | 0 | 0 | 0 | 0 | 0 |
| 2 | 0 | 1 | 0 | 0 | 0 | 0 | 1 | 1 | 1 | 1 | 0 | 0 | 0 |
| 3 | 0 | 0 | 1 | 1 | 0 | 0 | 1 | 1 | 0 | 0 | 1 | 1 | 0 |
| 4 | 0 | 0 | 1 | 0 | 1 | 0 | 1 | 0 | 1 | 0 | 1 | 0 | 1 |
| | | | ♠ | | | ♥ | | | ♦ | | ♣ | | |
| 5 | | | 0 | | | 0 | | | 1 | | 1 | | |
| 6 | | | 1 | | | 0 | | | 1 | | 0 | | |

The bar code is inklessly marked by depositing microscopic crystals having the same 'color' (white or off-white) as the background on which each of the bars is placed; the crystals may absorb in, the near-infrared or the near-ultraviolet (0.1μm–0.4μm), depending upon which wavelength is to be read by the reader. Particles which absorb in the near-ultraviolet are those of certain glassy materials and inorganic and organic salts. Particles which absorb in the near-infrared are various alkali metal and alkaline earth metal salts of fatty acids, for example calcium acetate, and other inorganic and organic compounds.

Alternatively the bar code may be marked by scuffing the surface of the face of the card so that the fibers of the card stock are dislodged sufficiently to absorb or scatter in the desired wavelength, so as to contrast in reflectivity with the undisturbed fibers of the background. Such scuffing may be accomplished with a fine wire brush or by blowing a stream of fine particles of an abrasive across the card stock.

The card 10 (FIG. 1) will be read when passed across the reading means in either direction along the longitudinal axis, requiring that two opposed edges of the rectangular card traverse the reading means.

Figure 2:
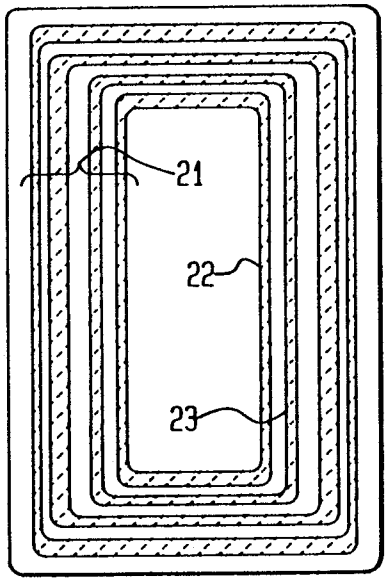
FIG. 2 is a representation of the playing card in which the face value of the card is not shown, but only showing the disposition of another bar coding as phantom shaded portions along each of the four margins of the card.

FIG. 2 represents a variation for bar-coding a card 20 with a code referred to by reference numeral 21, in which each wide bar 22 and each narrow bar 23 is peripherally continuous on at least two sides of the rectangle, and all the bars are spaced apart from one and another. Since the code is read by reading 8 bars, a set of bars to be read consists of four bars along two sides of the rectangle, and four bars from the opposed remaining two sides of the rectangle. If bit 1 happens to be the same as bit 8, or bit 2 happens to be the same as bit 7, or bit 3 happens to be the same as bit 6, then the bars corresponding to those bits will have the same width along the entire periphery and appear as continuous. As before, the width of the spacing of the peripheral bars must be at least as wide as the narrow bars.

The card 20 (FIG. 2) will be read when passed across the reading means in any orientation, requiring only that two opposed edges of the rectangular card traverse the reading means.

Referring now to FIG. 3, there is shown a card 30 with yet another bar coding configuration referred to by reference numeral 31, in which wide and narrow bars 32 and 33 respectively, similar to the bar coding of FIG. 1, but on a diminished scale several times smaller than that of FIG. 1, is reproduced repetitively a plurality of times in adjacent, parallel relationship in two adjacent rows. Each row has the same set of 8 bars except that each contiguous set is rotated 90° from the other. The card is identified as long as any set of 8 bars in either row is passed over the reading means. Thus the card will be read even if only two adjacent edges of the card traverse the reading means.

The difference in reflectivity read by the reading means determines whether the space read contains a bit. The reading means can only distinguish between reflective and non-reflective portions in the wavelength range visible to the reading means. The reading means therefore can use any wavelength range which is either in the infra-red or in the ultraviolet, the former being preferred.

Figure 4:
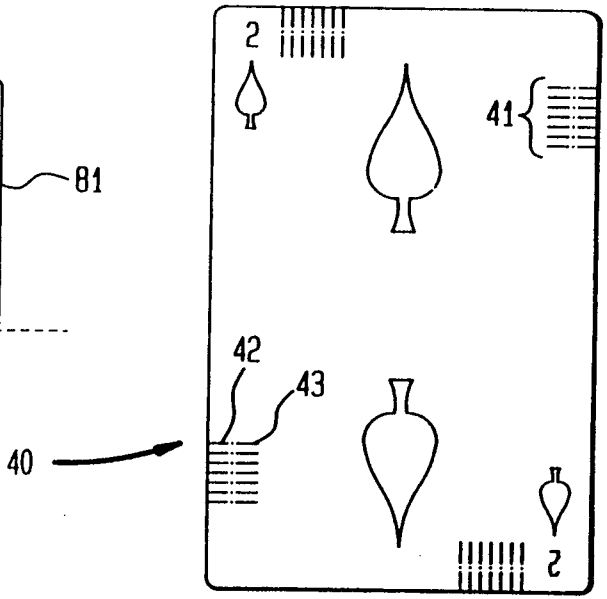
FIG. 4 is a representation of a playing card, specifically the two of spades, showing a portion of the textured bar coding in phantom outline, the bar coding being repetitively textured along the edges of the card.

Referring to FIG. 4 there is shown a card 40, specifically the 2♠ in which the code 41 (in phantom outline) is textured along each of the four edges of the rectangle without the wide and narrow bars 42 and 43 respectively, substantially overlapping the face markings. It will be appreciated that when they do overlap the face markings, the bars will not be visible.

The card 40 (FIG. 4) will be read when passed across the reading means in any orientation, requiring only that one edge of the rectangular card traverse the reading means.

It will now be evident that the inks used to print the visible indicia (face values) of the cards should not be readable by the reading means, and the bright colors used are generally infrared permeable. For example even black indicia such as the Ace of spades, which appears jet black to the human eye and would be expected to absorb in the infrared wavelength, can be printed in an ink which appears to be jet black to the human eye but does not absorb substantially in the infrared region.

An imprint of a bar code which most preferably absorbs in the infrared is obtained by depositing microscopic particles of powder, such as crystals from a solution of an inorganic salt such as barium sulfate, or a solution of an organic salt such as sodium acetate, rather than an ink. The particles are chosen for their absorptivity of the wavelength of light used by the reader. More preferably the bar code is obtained by etching or texturing the surface of the card with an abrasive powder or by mechanical means so as to produce a code of contrasting textures, the bars being dull (that is, infrared absorptive) and leaving the spaces between the bars, and the background shiny (that is, infrared reflective); or, less preferably, vice versa. In either case, whether produced by a solution or by etching or texturing, a card is encoded with the bar code without using an ink, i.e. inklessly.

In another embodiment, a dispersion or solution of inorganic or organic particles used to produce the bar code may be chosen to fluoresce in the visible or infrared when illuminated by an appropriate UV light source, contrasting with the spaces and background.

In general, a clandestine bar code, namely one which cannot be read by the naked eye, may be textured into any surface which already bears visible indicia, for example, a garment label, a ticket to a ball game, stock certificates, legal documents, bank drafts, checks and bank notes. When the code is textured, it will be readable by either an infrared or ultraviolet detection system, that is, in a range outside the visible. When the surface to be coded is smooth, one has the option of providing either a textured bar code, or a code with an invisible dispersion of dye or microscopic powder.

In the particular instance of conveying printed information in a predetermined limited area, for example a printed page of text, the use of invisible solutions readable in the infrared or ultraviolet may be used to increase the density of text several fold. For example, a page of conventionally printed text, printed in ink which to the eye appears jet black, may be overprinted with an invisible solution which is readable in the infrared, and again overprinted with an invisible solution which is readable in the ultraviolet. Thus, the number of forms of text is limited only by the optical wavelength band width of the detectors, the band width of the exciting radiation, and the responsivity of the inks or solutions, whether absorbers or fluorescers. In some instances, the inks or solutions may not be overprinted one on top of the other, but within unprinted or blank spaces such as interlinearly in a page of conventional text.

THE LAMINATED PLAYING CARD

The laminated card may be read either with infrared or ultraviolet light, as described hereinabove. The following description refers only to the use of infrared light to read the code because implementing details for making a card and reading it with ultraviolet light are significantly different in execution as compared to the details of construction of the preferred embodiment described herein.

Figure 5B:
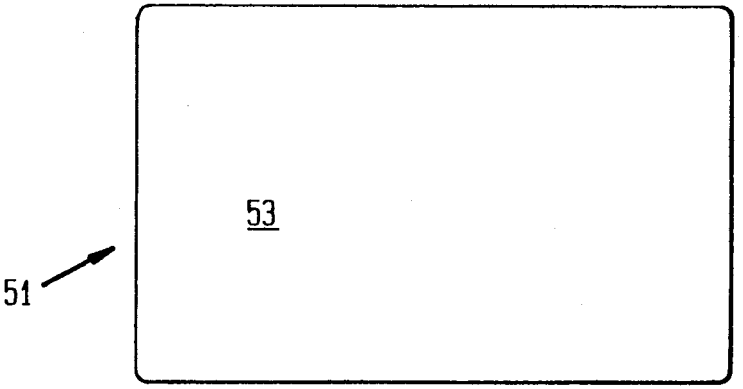
FIG. 5B is a plan view of the front surface of the base sheet depicting a fully reflective aluminized or similar surface which reflects light of substantially all wavelengths in the visible, near-infrared, and near-ultraviolet regions.
Figure 5D:
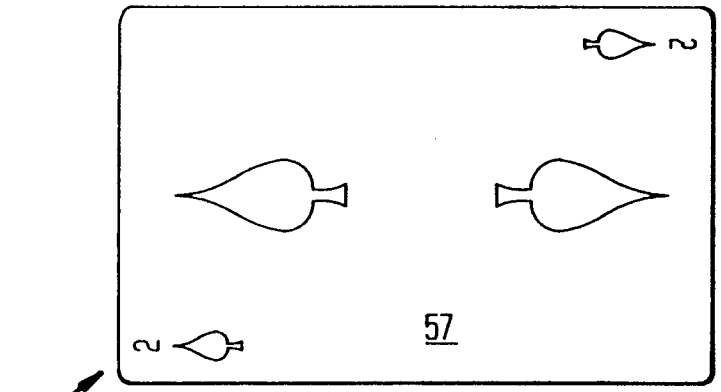
FIG. 5D is a plan view representing the face of the two of spades, which like the other cards in the deck are printed in visible-light-absorbing printing inks, which face appears to be of a conventional card because the card stock does not noticeably show that the rear surface of the top sheet is blackened; but the blackened surface hides the bar code in colloidal carbon.
Figure 5A:
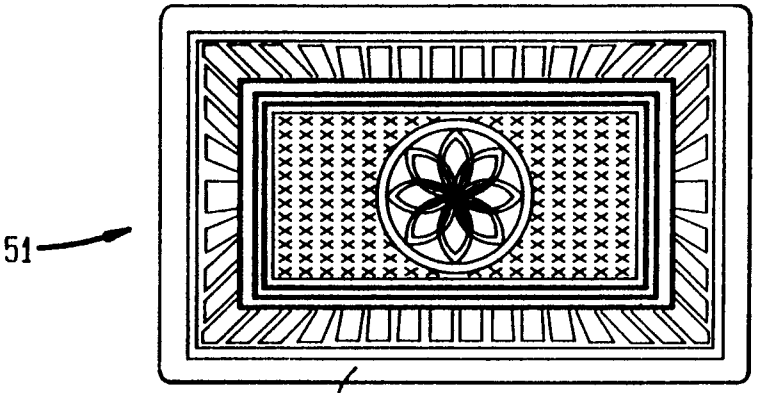
FIG. 5A is a plan view of the rear surface of the lower lamina (base sheet) depicting a fanciful printed design such as is found on a conventional playing card.
Figure 5C:
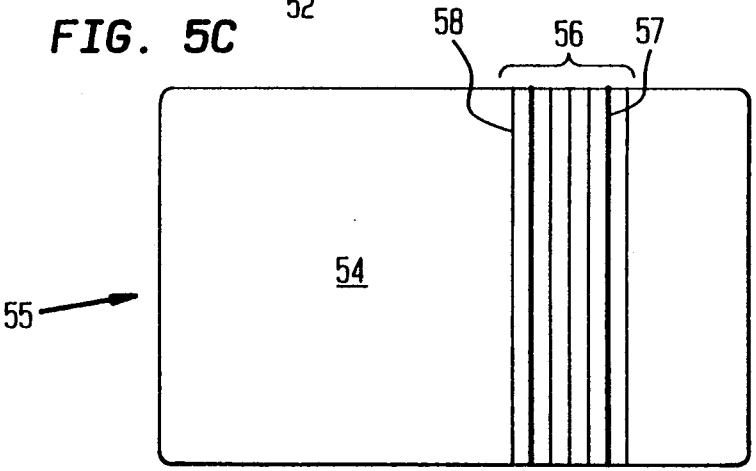
FIG. 5C is a plan view of the rear surface of the upper lamina (top sheet) depicting a fully visible-light-absorbing but infrared-transmitting surface of black ink on which is overprinted a bar code in colloidal carbon (India ink) which absorbs in the near-infrared region.

Referring to FIG. 5A there is shown the rear surface 52 of the base sheet 51 of a card, which rear surface is conventionally printed with a design 59. When laminated to the top sheet 55 (FIG. 5C) the laminated card will appear to be a conventional playing card. To this end, the base sheet is only one-half as thick as conventional card stock. FIG. 5B illustrates the front reflective surface 53 of the base sheet 51. FIG. 5C illustrates the rear surface 54 of the top sheet 55, also made of half-thickness conventional playing card stock, the entire rear surface 54 being covered with a spreadable medium such as infrared transmitting black ink. In the best mode, a bar code 56 consisting of wide bars 57 and narrow bars 58 of infrared absorbing colloidal carbon (India ink) is concealed within the playing card by printing the code on the blackened rear surface 54. The intermediate layer consists of the reflective surface 53 and the bar code 56 on the blackened surface 54. FIG. 5D illustrates the white surface 57 of the face of the card on top sheet 55 on which face the value of the card is designated.

When top and bottom sheets 56 and 51 are laminated the card appears to be a conventional card with a conventional rear surface 52 and a conventional face 57.

Figure 6:
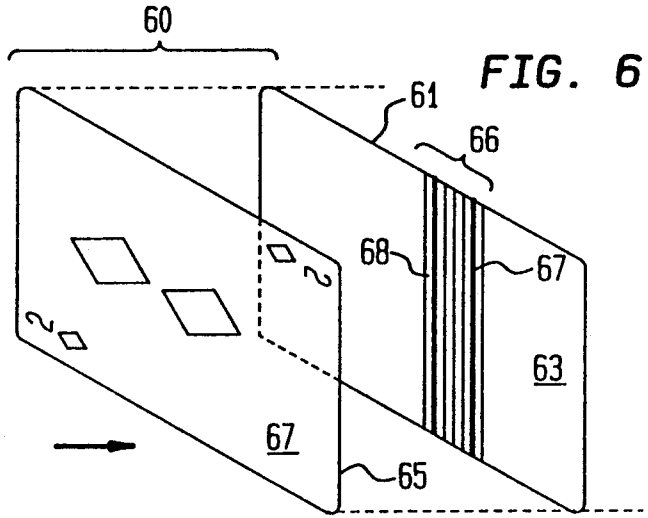
FIG. 6 is a perspective exploded view schematically illustrating a laminated playing card made from only two, namely top and base sheets, which when laminated appear to be conventional card stock; a non-self-supporting intermediate layer consists of only the bar code deposited as solid particles of infrared absorbing material, preferably smaller than 44μm (micrometers) in average size, on the front surface of the base sheet.

Referring now to FIG. 6 there is shown a card 60 (2 ♦) to be laminated from half-thick base and top sheets 61 an 66 respectively in a manner analogous to that described above. The face 67 is printed conventionally and the rear surface (not visible) of the top sheet 66 carries no code and is unmarked. The front surface 63 of the base sheet 61 carries only the code 66 textured with infrared absorbing solid particles deposited in wide and narrow bars 67 and 68 respectively, as shown, in at least one bar code configuration, but preferably repetitively. The front surface 63 of the base sheet is otherwise unmarked. The rear surface (not seen) of the base sheet is printed with a conventional design as shown in FIG. 5A. The powder used for the bar code is not visible against the surface of the half-thick card stock but absorbs in the infrared region so as to be read by the reader. The intermediate layer is therefore only the powder.

Figure 7:
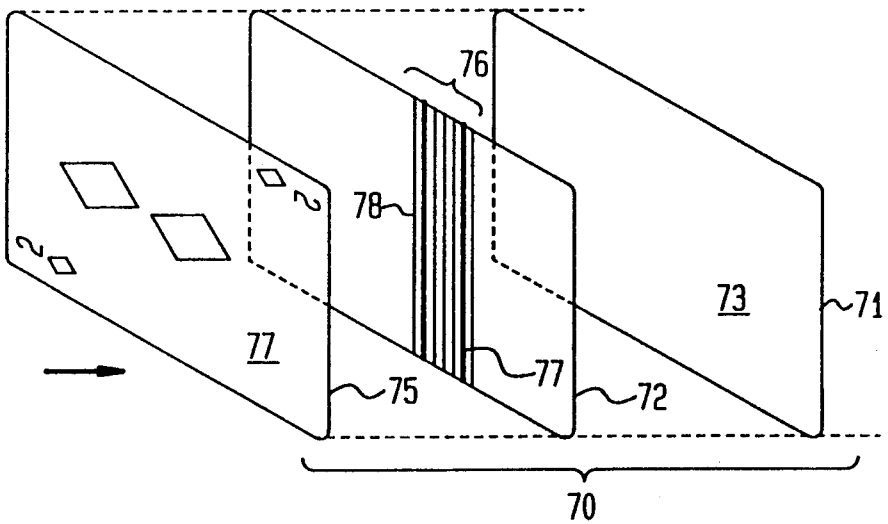
FIG. 7 is a perspective exploded view schematically illustrating a laminated playing card in which the intermediate layer is a self-supporting layer of reflective material on which strips of infrared absorptive material, such as colloidal carbon, are deposited in a bar code. The base sheet is of conventional stock about one-half as thick (about 5 mils) as conventional card stock (about 10 mils).

As illustrated in FIG. 7, the card 70 consists of top and base sheets 75 and 71 of half-thick card stock, the front face 77 being white and carrying the face value (2 ♦) of the card, the front face 73 of the rear sheet being unmarked, and the rear face of the base sheet being printed with a design as shown in FIG. 5A. The intermediate layer 72 is provided by a thin metal (aluminum) or metallized film which reflects essentially all the light falling upon it. Such a metallized intermediate layer may be provided by any conventional technique for applying a thin film coating, for example, by vacuum deposition, sputtering or electrolytic deposition. By "thin film" we refer to a thickness which is sufficient to reflect substantially all infrared and visible light falling upon it. A preferred metallized layer is provided by sputter ing or vacuum depositing aluminum, nickel, tin, copper and the like. Most preferred is aluminum because of its high reflectivity, lower initial optical transmissivity and despite its tendency to oxidize. The conductivity of the metallized layer is immaterial for the purpose of this invention, as the intermediate layer is substantially electrically insulated by the upper layer and the base layer, each of which is typically formed from insulating materials. An appropriate choice of a metal for the reflective intermediate layer may be made by reference to the teachings in the text "Physics of Thin Films" by J. L. Vossen Vol 9, Academic Press, New York (1977).

The code 76 is provided with colloidal carbon as before in wide and narrow bars 77 and 78, preferably repetitively, but at least once. The code may also be provided across the transverse axis (orthogonal to the code shown), though the second code is not shown on the same Fig to avoid confusion. In addition the code may be provided in any of the configurations shown in FIGS. 1–4 depending upon how much flexibility of orientation is desired in reading the card.

The code being in carbon, a material which also strongly absorbs in the visible, the bars are faintly visible through the top sheet through the background where there is no face value marked on the card. Instead of covering the rear face of the card with infrared transmitting black ink, as before, the rear face of the top sheet is covered with a finely divided white powder which scatters visible light. The face 77 of the card thus appears highly reflective and the bar code is effectively hidden because light from the bar code does not get transmitted through the front face 77 of the card.

If the code is provided in a "white" powder which is not visible against the normally reflective white surface of the base sheet, the code is hidden from view even when the card is held up and viewed against a strong light.

In addition to hiding the code from human view, it is desirable to provide maximum contrast between the infraredabsorbing code and the reflective surface against which it is read by the reader. It will be appreciated that a playing card is typically to be read by the electro-optic means in the reader when a deck is to be dealt in normally bright ambient lighting such as is used in a large room in which a bridge tournament is held. Thus, some of the visible light in the range from about 5% to 20%, falling on the "reader" is transmitted through the top sheet (upper layer) and is reflected by the intermediate layer, along with infrared light which the reader uses to read the code. When substantially all the transmitted visible light or infrared light seen by the reading means is reflected by the intermediate layer which performs a mirror-like function (except for those areas covered by the code), the contrast between the coded areas where the infrared light was absorbed, and, the remainder of the field (around the bar code) of the intermediate layer which reflects both infrared and visible light, is diminished. This diminished contrast makes it difficult to read the bar code with an economical reading means.

It is therefore preferred to provide a spreadable medium which functions as a selectively light-permeable auxiliary layer positioned between the bar code and the rear face of the upper layer (that is, the face of the upper lamina in contact with the intermediate layer). The auxiliary layer is permeable to infrared light but substantially impermeable to visible light which is either absorbed or scattered.

Such a selectively light-permeable auxiliary layer which absorbs and/or scatters visible light is essentially transparent to infrared light. This auxiliary layer is provided by the black ink commonly used in Papermate Flair brand pens. Such an ink may be painted on the rear face of the upper layer so that essentially no visible light will be transmitted through it. Instead of an ink, a dye or paint having the same optical characteristics may be equally effective to serve the function of a thin, spreadable, selectively light-permeable medium.

Instead of covering the rear face of the upper layer with the spreadable, selectively light-permeable medium (ink, paint or dye), the auxiliary layer may be spread under the code on the intermediate layer. If the infrared-transmitting black ink is used, the surface (before the sheets are laminated) which will appear uniformly black to the human eye, when it (the intermediate layer covered with the medium) is viewed in the visible spectrum.

Though the rear face of the upper layer is seen to be black, the face of the upper layer appears to be that of a conventional playing card. When the laminated playing card is viewed against a bright light in the visible spectrum, the playing card appears to be a conventional card and the code on the intermediate layer is not visible to the human eye.

To avoid using an infrared-permeable ink, the auxiliary layer of spreadable medium may be a thin layer of visible-light-scattering particles. Such particles are microspheres necessarily having a diameter in the range from about 0.5μm to 0.6μm (micrometers) commercially available under the Scotch-Lite brand from 3M Company. Such a thin layer of microspheres may be deposited from a suspension in a suitable liquid. The specific size range of the microspheres is required to scatter visible light which is reflected from the intermediate layer, and to allow infrared light having a wavelength in the range of about 0.8μm or higher, to be transmitted so as to increase the contrast of the code read.

When so scattered, the visible light cannot be seen by the reading means in the reader, and the contrast between the reflected infrared light (substantially all of which is transmitted through the spreadable medium) and that absorbed by the bar code is increased.

It should be noted that Scotch-Lite microspheres are routinely used in the paper industry to reflect substantially all the visible light which falls upon paper containing them. In such a use (as a reflective material) the sizes of the microspheres are randomly scattered over a wide range with the specific intent of performing a mirror-function, that is, not transmitting any light, irrespective of its wavelength.

The high reflectivity of the intermediate layer provides from 50% to 90% contrast on the bar code pattern in the infrared region, depending upon the reflectivity of the metallized layer and the effectiveness of absorption or scatter of the infrared permeable auxiliary layer, whether ink, paint, dye, or microspheres.

Figure 8:
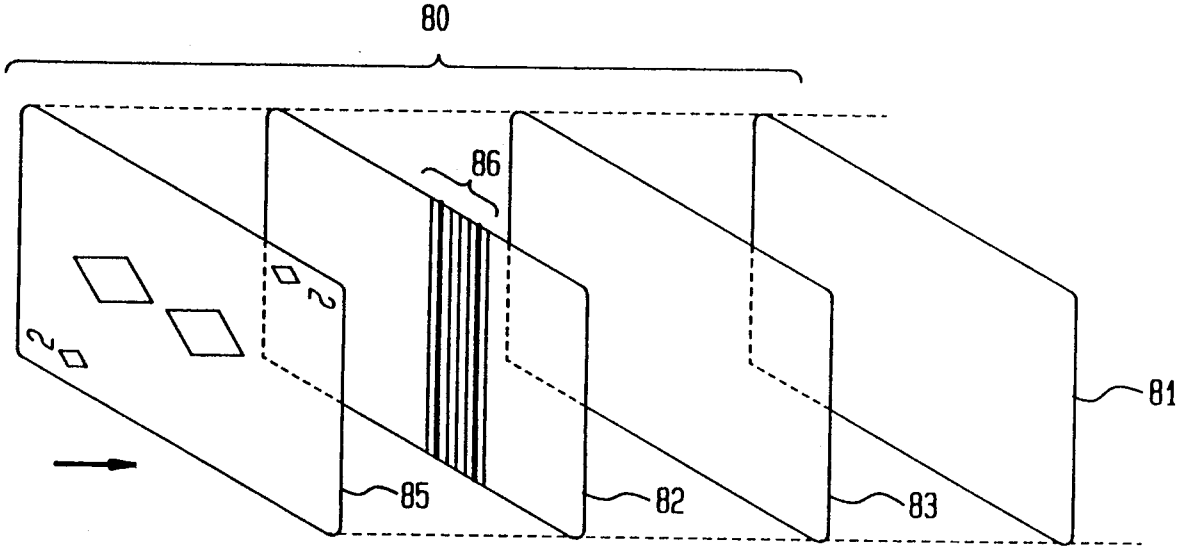
FIG. 8 is a perspective exploded view schematically illustrating a laminated 2 of diamonds in which the intermediate layer is a combination of a non-self-supporting film of reflective foil less than 0.5 mil thick on which is deposited a bar code of colloidal carbon, and a self-supporting film greater than 0.5 mil thick which films together are sandwiched between the upper and lower laminae.

Referring to FIG. 8 there is schematically illustrated a laminated playing card 80 in which the base and top sheets 81 and 85 are of half-thickness card stock, as before, but the intermediate layer is formed by a combination of a non-self-supporting layer 82 and the self-supporting layer 83. The layer 82 may be any reflective film upon which the code 86 is printed or otherwise deposited, and the layer 82 is supported on the layer 83. As before the code may be provided in any one of the numerous configurations referred to hereinabove. As before, depending upon the choice of material from which the code is produced, the rear surface of the top sheet 85 (the term "sheet" is used interchangeably with the term "layer" herein) may or may not be covered with a visible light-absorbing and/or scattering auxiliary layer. Alternatively, the layer 83 may reflect visible light to the front face, and the layer 82 transparent to visible and infrared light. The thicknesses of the combined intermediate layer is small enough to be substantially unnoticeable between the top and base sheets.

The upper layer may be of any conventional material such as a pigmented or unpigmented substrate, whether paper or cloth, paper coated with a cured latex of a polymer, or a sheet of synthetic resinous material, provided the upper layer is substantially permeable to infrared (or ultraviolet light, if it is used).

The base layer may be of any conventional material which may be the same as that of the upper layer or different. The function of the base layer is mainly to provide a support for the intermediate layer. The base layer may be permeable to all wavelengths, as would be a thin sheet of clear glass, or opaque, as would be a sheet of metal greater than 0.5 mil thick. Since the playing card of this invention is to be read only face-down, by the reader, the base layer 81 provides no optical function whether it is transparent or opaque.

However, in the two-piece laminated card (FIGS. 5A-5D and FIG. 6), the front surface of the base sheet itself provides a reflective surface, or a support for a more reflective surface to reflect both visible and infrared wavelengths. In FIG. 7, the front face 73 of the base sheet 71 may be reflective when the intermediate layer 72 transmits visible and infrared light.

The components of the laminated card are preferably adhesively bonded together with an adhesive which is essentially permeable to infrared light. Such an adhesive is commonly available rubber cement, or the glue in a commercially available solid glue stick. Most preferred is an infrared transmitting epoxy resin such as Epon 828 from Shell Chemical. When the intermediate layer is supported on a thin sheet of thermoplastic synthetic resin, for example poly(vinyl chloride), the thin sheet may be thermally bonded to the base layer and to the upper layer dispensing with the use of an adhesive. In another embodiment, the rear surface of the top sheet and the front surface of the base sheet may each be coated with a thermally bondable resin which is essentially transparent to the wavelength absorbed by the indicia of the code.

It will now be evident that the best mode for producing a coded playing card which is visually essentially indistinguishable from a conventional rectangular playing card will depend in large part upon the economics of manufacturing the card, particularly with respect to the imprinting of the code on the card, and more particularly when the code is a textured code. Since the textured code is invisible to the human eye but textured only in the sense that the reader sees it as being textured, the sensitivity of the electro-optic reading means of the reader is a necessary consideration with respect to the choice of the degree of "scuffing" required or the organic or inorganic compound used to absorb wavelengths to be read by the reading means.

For example, the non-laminated card may be made by taking a conventional playing card and microscopically scuffing its surface with a fine wire brush so that the disrupted fibers are essentially invisible to the human eye. Alternatively, microscopic solid particles of a compound which transmit visible light, but substantially absorb in the infrared or ultraviolet ranges (depending which one is used for the reading means) may be coated with an adhesive which transmits visible light, and the particles deposited on the card's surface, either across the entire face, or only near the margins, leaving the remainder of the card's printed face uncoded, as described hereinabove. Still another alternative is to code the face of a card with a solution of an organic dye which transmits visible light (therefore has no pigmenting value), but substantially absorbs in the infrared or ultraviolet ranges.

It will now be evident that though the face values of the card are conventionally printed in visible light absorbing inks, the inks chosen may not be conventional since they must also be substantially permeable to the wavelength used by the reading means to read the code, particularly if the code is imprinted over the face values of the cards, as is the case in some embodiments of the non-laminated card; and, is the case in all embodiments of the laminated card. This requirement of the inks to be used can only be arrived at after one has decided that the card is to be coded as described hereinabove. Further, producing a laminated playing card can only be arrived at after one has decided that the indicia of the card is to be placed behind the front surface of the conventionally printed card.

The laminated card is preferably made by starting with two nearly opaque sheets (top and base) of white card stock each sheet being about half the thickness of conventional card stock. The outer (when the card is laminated) surfaces of the card stock to be printed with the face values of the cards and the fanciful decorative design on the rear, may be 'finished' differently from the inner surfaces. In the most preferred embodiment of the method which results in a playing card described in FIGS. 5A-5D, the top and base sheets are each at least large enough to print one deck of at least 52 cards. The entire rear surface of the top sheet is coated with infrared-transmitting black ink. The entire front surface of the base sheet is reflectorized with a coating of aluminum either by depositing it directly on the surface, or by bonding an aluminized sheet of Mylar polyester. Then the bar code is printed or otherwise deposited on the aluminum, and the top and base sheets, with the aluminized sheet therebetween, are adhesively bonded together with thin layers, less than about 13μm thick, of an infrared-transmitting epoxy resin. All layers of the card are thus adhesively bonded together to form a large laminated sheet, and the large laminated sheet is then printed with the face values of the cards, then cut into individual cards of a deck.

In an alternative method, microscopic particles of an infrared absorbing compound are coated with an adhesive and deposited on either the rear surface of the top sheet which have a sufficiently reflective surface, or, the front surface of the base sheet, in the desired code configuration for each card. The top and base sheets are then adhesively bonded together with an infrared-transmitting adhesive to form a laminated sheet, and the large laminated sheet is then printed with the face values of the cards, then cut into individual cards of a deck.

Alternatively, the powder particles are coated with a thermoplastic resin and deposited in a desired code configuration as described on either the rear surface of the top sheet or the front surface of the base sheet. The sheet is then heated to a temperature above the glass transition temperature or melting point of the thermoplastic resin so that the particles are bonded to the surface of the sheet. The top and base sheets are then adhesively bonded together so as to appear like a sheet of conventional card stock which is then printed with infrared-transmitting inks.

In still another embodiment, the rear surface of the top sheet and the front surface of the base sheet are each coated with a thin layer less than 13μm thick of a first infrared-transmitting thermoplastic resin. A self-supporting layer of a reflectorized (aluminized) second thermoplastic resin having a glass transition temperature no higher than that of the first resin, is imprinted with the desired code. The self-supporting coded layer is sandwiched between the coated surfaces of the top and base sheets and heated under pressure until both sheets are thermally bonded to the self-supporting layer. The laminated large sheet so formed is then printed with the face values of the cards, as described, above, and cut up into individual cards of the deck.

Having thus provided a general discussion, described the playing card in detail, and other standardized documents generally which documents could be constructed using the teachings herein, and having illustrated the specific embodiment of the playing card with specific examples of the best mode of making and using it, it will be evident that the invention has provided an effective and economical solution to a difficult problem. It is therefore to be understood that no undue restrictions are to be imposed by reason of the specific embodiments illustrated and discussed, except as provided by the following claims.

We claim:

1. A method for making a laminated playing card, comprising, positioning first and second sheets of card stock of about equal dimensions, each about 5 mils thick, said first sheet having a front surface to be printed with insignia for the face value of said playing card, and said second sheet having a rear surface to be printed with a design, coating said first sheet's rear surface with a coating which absorbs or scatters visible light but transmits in wavelengths invisible to the human eye, depositing machine-readable coding indicia on said rear surface of said first sheet, coating said second sheet's front surface with a reflective coating, bonding together said first and second sheets in coated surface-to-coated surface contact to form laminated card stock, and, printing said front surface of said first sheet with said insignia in inks which absorb and reflect in the visible range to produce characteristic colors of said insignia, but which inks are substantially transparent to said wavelengths.

2. The method claim 1 wherein said card stock is flexible card stock and said wavelengths are in the infrared region.

3. The method claim 1 wherein said card stock is flexible card stock and said wavelengths are in the ultraviolet region.

4. The method of claim 1, including repetitively depositing said machine-readable insignia on said rear surface to enable said card to be read in any generally lateral orientation when passed over a machine which reads said machine-readable insignia.

5. A method for making a coded playing card having imprinted on its face, value-defining insignia identifying the value of the card in both human readable and machine-readable form, comprising imprinting said face of said card with said insignia which absorbs wavelengths in the visible region and is therefore visible to a human eye, but is essentially transparent to wavelengths invisible to the human eye; and, inklessly texturing said face of said card with machine-readable insignia which is invisible to the human eye.

6. The method of claim 5 wherein inklessly texturing said face comprises using a dye or microscopic powder having essentially no pigmenting value, said machine-readable insignia is a bar code, and card stock is flexible card stock.

7. The method of claim 5 wherein said machine-readable insignia is a bar code, and said card stock is flexible card stock, and said method includes, repetitively imprinting said face with said machine-readable insignia to enable said card to be read in any generally lateral orientation when passed over a machine which reads said machine-readable insignia.

8. The method claim 7 wherein said wavelengths invisible to the human eye are in the infrared region.

9. The method claim 7 wherein said wavelengths invisible to the human eye are in the ultraviolet region.

10. A method for making a coded laminated playing card without changing the normal appearance of said card, said playing card having an upper sheet of card stock imprinted with value-defining insignia visible to the human eye to define the face value of said playing card, a base sheet of card stock the back surface of which is imprinted with a design visible to the human eye, and an intermediate layer with machine-readable coding for said insignia laminated between said upper sheet and said base sheet, and said coding absorbs wavelengths invisible to the human eye, comprising, (i) placing said base sheet about 5 mils thick in a position to allow superimposition of said intermediate layer and machine-readable coding;

(ii) placing said upper sheet about 5 mils thick upon said intermediate layer and machine-readable coding; and, (iii) laminating said upper sheet to said base sheet;

whereby said upper sheet to said base sheet;

whereby said laminated coded card is made with an upper sheet which transmits wavelengths invisible to the human eye, but absorbs wavelengths visible to the human eye to allow said face value to be seen by human eye; and, with said machine-readable coding sandwiched between said front surface of said base sheet and said upper sheet's rear surface.

11. The method of claim 10 wherein said machine-readable coding is repetitively duplicated to enable said card to be read in any generally lateral orientation when passed over a machine which reads said machine-readable coding.

12. The method claim 11 wherein said card stock is flexible card stock and said wavelengths invisible to the human eye are in the infrared region.

13. The method claim 11 wherein said card stock is flexible card stock and said wavelengths invisible to the human eye are in the ultraviolet region.

14. The method of claim 11 wherein said intermediate layer comprises a non-self-supporting bar code.

15. The method of claim 14 wherein said intermediate layer includes a self-supporting layer on which said non-self-supporting bar code is carried.

16. The method of claim 15 wherein said self-supporting layer reflects visible light to said upper sheet.

17. The method of claim 16 wherein said self-supporting layer is metallized to reflect visible light to said upper sheet.

* * * * *